US005312038A

United States Patent [19]

Merlanti et al.

[11] Patent Number: 5,312,038

[45] Date of Patent: May 17, 1994

[54] DRAINAGE SYSTEM FOR A RAILROAD SUPERSTRUCTURE FOR SUPPORTING SLEEPERS

[76] Inventors: Paolo Merlanti, Via Senato, 8, 20121; Mario Santini, Corso Matteotti, 10, 20121, both of Milano, Italy

[21] Appl. No.: 964,768

[22] Filed: Oct. 22, 1992

[30] Foreign Application Priority Data

Oct. 23, 1991 [IT] Italy ..... MI91-A-02819

[51] Int. Cl.[5] ..... E01B 1/00

[52] U.S. Cl. ..... 238/7; 238/382

[58] Field of Search ..... 238/2, 3, 4, 5, 6, 7, 238/382; 246/453; 29/428

[56] References Cited

U.S. PATENT DOCUMENTS

| | | | |
|---|---|---|---|
| 1,099,697 | 6/1914 | Gilbert | 238/7 |
| 3,814,412 | 6/1974 | Britton et al. | 238/7 X |
| 3,907,200 | 9/1975 | Bernard | 238/7 |
| 4,232,822 | 11/1980 | Hahn et al. | 238/7 |
| 4,266,719 | 5/1981 | Ortwein et al. | 238/7 X |
| 4,616,395 | 10/1986 | Farese et al. | 238/7 X |
| 4,728,032 | 3/1988 | Beigl et al. | 238/382 |
| 5,163,614 | 11/1992 | Tamas et al. | 238/2 |

FOREIGN PATENT DOCUMENTS

| | | | |
|---|---|---|---|
| 2354960 | 5/1975 | Fed. Rep. of Germany | 238/7 |
| 2354958 | 6/1975 | Fed. Rep. of Germany | 238/7 |
| 2830137 | 1/1980 | Fed. Rep. of Germany | 238/7 |
| 011504 | 1/1977 | Japan | 238/7 |
| 0000031 | 1/1979 | World Int. Prop. O. | 238/6 |

OTHER PUBLICATIONS

Civil Engineering Newsletter National Capital Section, ASCE vol. XX11, No. 7, "Floating Slabs, Padded Rails, Keep Metro Quiet", Feb. 1975.

*Primary Examiner*—Michael S. Huppert
*Assistant Examiner*—Scott L. Lowe
*Attorney, Agent, or Firm*—Bucknam and Archer

[57] ABSTRACT

A railroad superstructure framework made in the form of a reinforced concrete block is provided on a top face thereof with a plurality of evenly spaced parallel recesses of a certain depth. Each recess receives a sleeper having a height greater than the certain depth. A middle region of the concrete block is provided with a channel element transversely crossing the plurality of recesses. A plurality of draining channels extend transversely from the channel element to an outside environment to allow for water drainage from the channel element of the concrete block.

2 Claims, 4 Drawing Sheets

II
III
10
8
8
6
2
2
5
2
7
2
4
7
7
7
6
7
6
II
III

DRAINAGE SYSTEM FOR A RAILROAD SUPERSTRUCTURE FOR SUPPORTING SLEEPERS

BACKGROUND OF THE INVENTION

The present invention relates to a railroad superstructure supporting framework, with reinforced concrete prefabricated elements, and a prefabricated reinforced concrete platform therefor.

Prior railroad superstructure supporting frameworks comprised pre-compressed reinforced concrete sleepers supported on a ballast of crushed stones.

Such a conventional system has a great use flexibility and can exploit the natural adaptability of the crushed stones to unexpected stresses.

On the other hand, this system requires frequent maintenance operations, with a consequent slowing down and interruption of the train traffic, in particular in a case of a mixed type of traffic with a high variability of load per axle, speed and features.

Moreover, such a conventional system provides for the use of broad building and operation tolerances, which are not compatible with the requirement related to the use of high speed trains.

Because of this reasons, in these last years there have been experimented, in several countries, different types of supporting frameworks, for example including sleepers directly applied to a foundation made of reinforced concrete.

Actually, in these alternative systems the maintenance requirements are very reduced; however, possible breakages of the structure and components thereof require very expensive and delicate repairing operations, for re-building in situ the broken concrete foundation and for replacing the degraded bedding materials. Thus, a possible replacing of prefabricated components, if required, is such as to nullify the provided advantages.

In fact, in these supporting frameworks in which the sleepers are directly supported on concrete material, it is not possible to exploit the natural adaptability of the crushed stones to unexpected stresses and, moreover, these systems do not posses the use flexibility characterizing the conventional supporting framework system.

Because of the above mentioned reasons, the attempts to design new systems have not provided an acceptable solution, and the broad range of different approaches attempted through the overall world, sometimes on a large scale, is an evident proof of this.

In this connection it should be pointed out that short duration and small scale experiments in this field do not provide a significative information and this slows down the development time of new technologies.

On the other hand, there subsists a great need of a railroad superstructure supporting framework which has a better geometric configuration, a greater reliability and duration and, moreover, can be easily fitted to existing railroads while reducing the environmental impact especially with respect to the noise and vibrations.

SUMMARY OF THE INVENTION

Accordingly, the main object of the present invention is to provide a new type of railroad superstructure supporting framework which allows to greatly reduce the building, operation and maintenance tolerances.

Another object of the present invention is to provide such a railroad superstructure supporting framework which, in addition to increasing the stability of the rails, under dynamic loads, is also adapted to greatly reduce the vibrations transmitted to the train cars and the encompassing environment.

Another object of the present invention is to provide such a railroad superstructure supporting framework which requires very reduced programmed maintenance operations with respect to the prior art railroad superstructure supporting frameworks.

This aspect is particularly important both for railroad tracks in environments polluted by powders, fumes and noise, as well as in tunnels, and for railroad tracks of a high speed traffic type and with a reduced possibility of alternative tracks, because of the geomorphologic characteristics of the environment.

According to one aspect of the present invention, the above mentioned objects, as well as yet other objects, which will become more apparent hereinafter, are achieved by a railroad superstructure supporting framework including reinforced concrete prefabricated elements, characterized in that said supporting framework comprises prefabricated platforms, each comprising a reinforced concrete block having, on a top face thereof, a plurality of evenly spaced parallel recesses provided for receiving each a sleeper for supporting rail elements, through the interposition of a bedding material.

BRIEF DESCRIPTION OF THE DRAWINGS

Further characteristics and advantages of the railroad superstructure supporting framework with reinforced concrete prefabricated elements according to the present invention will become more apparent from the following detailed description of a preferred embodiment thereof which is illustrated, by way of a merely indicative but not limitative example, in the figures of the accompanying drawings where.

DESCRIPTION OF THE PREFERRED EMBODIMENT

Figures 1, 2, 3:
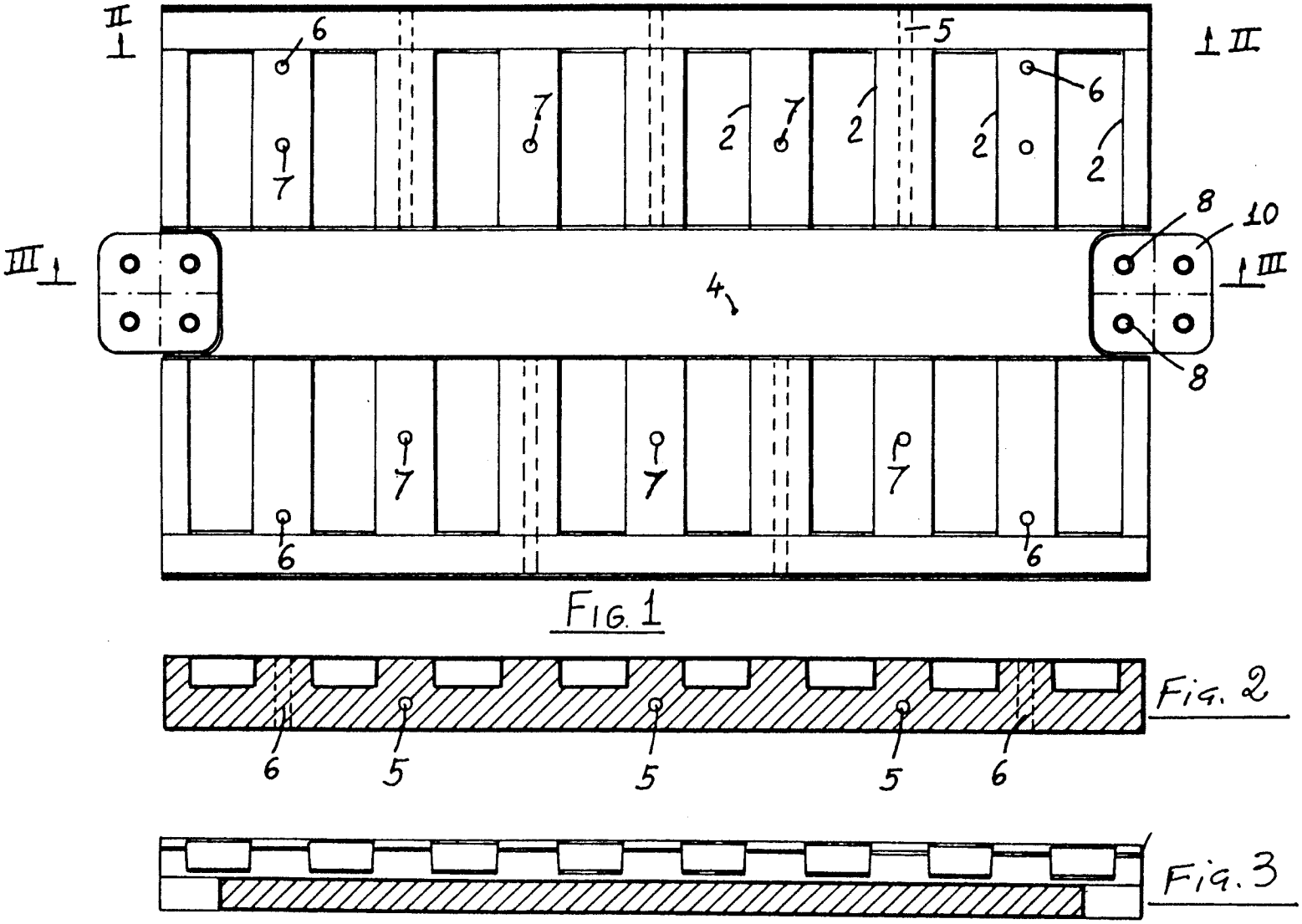
FIG. 1 is a top plan view of a prefabricated platform for making the railroad superstructure supporting framework according to the present invention.
FIG. 2 is a cross-sectional view substantially taken along the like II—II of FIG. 1.
FIG. 3 is another cross-sectional view substantially taken along the line III—III of FIG. 1.
Figure 4:
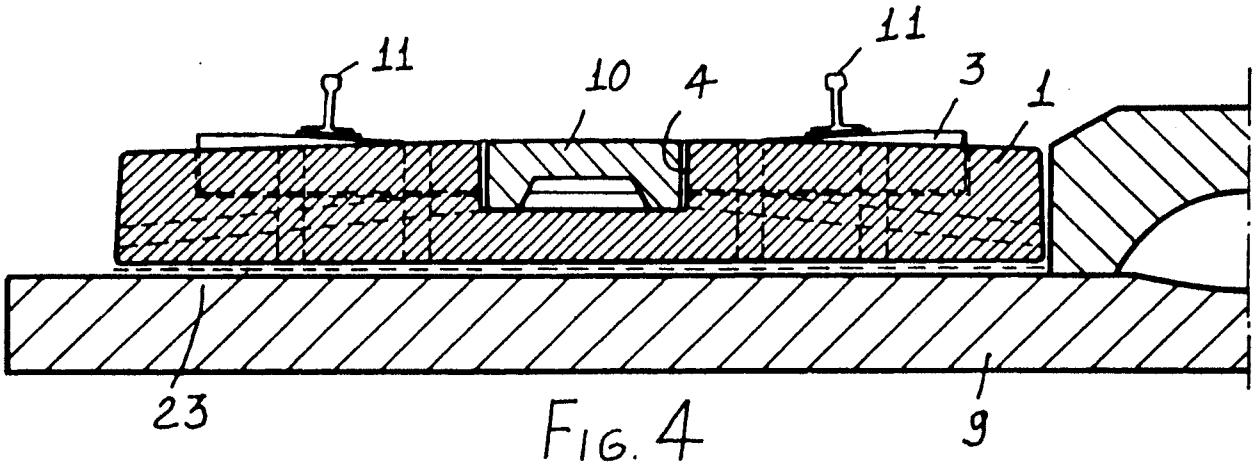
FIG. 4 is a cross-sectional view, taken at the reinforced concrete platform, of the subject railroad superstructure supporting framework.
Figure 5:
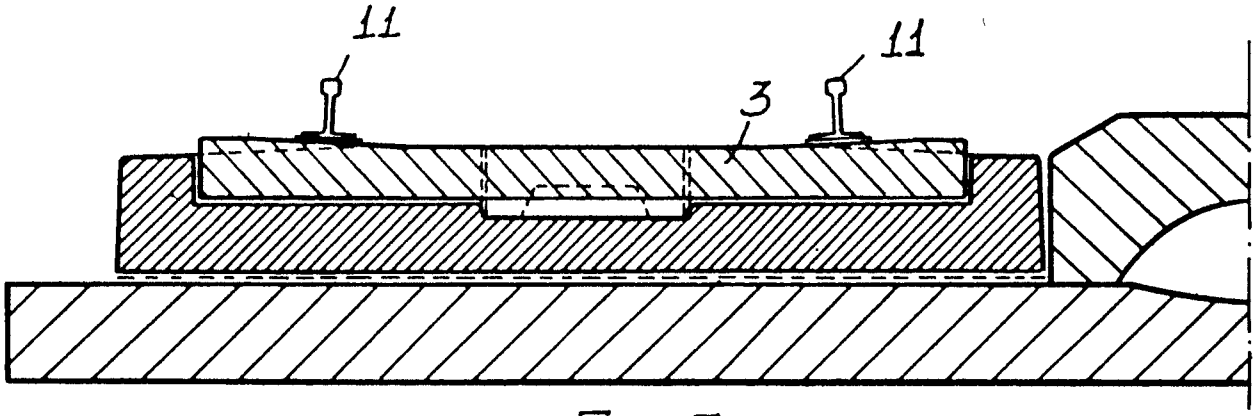
FIG. 5 is a further cross-sectional view of the subject railroad superstructure supporting framework taken at a sleeper thereof.
Figure 6:
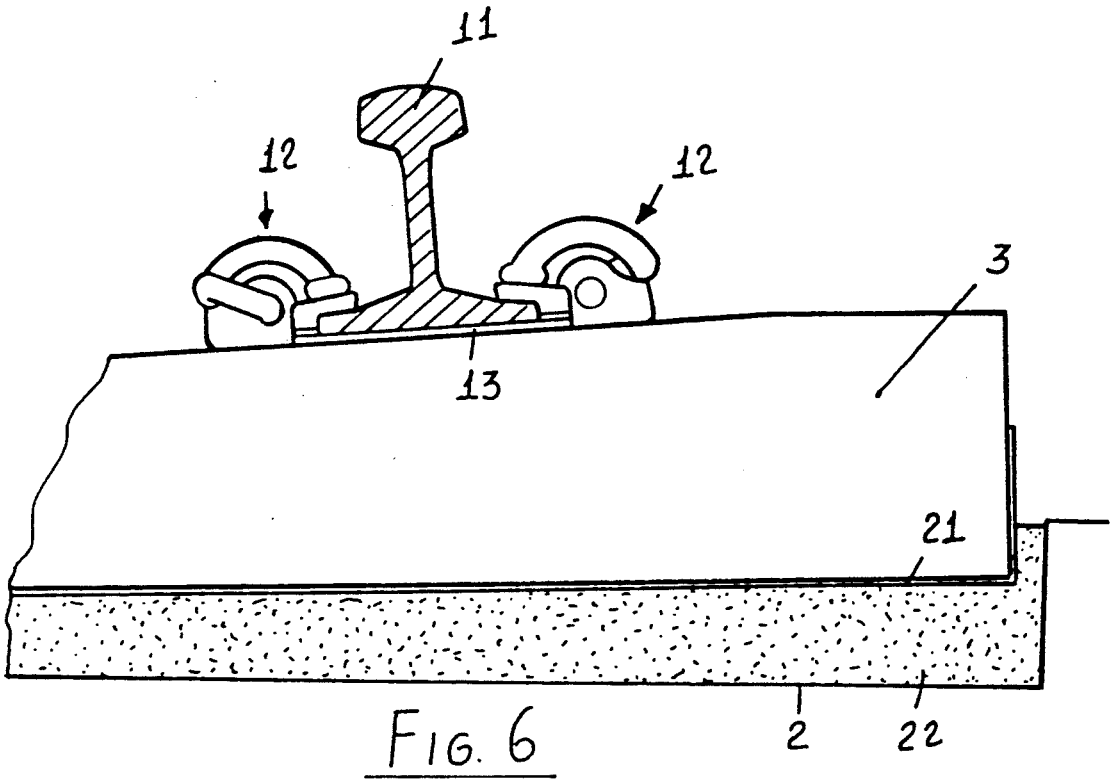
FIGS. 6 to 9 are schematic views showing several possibilities for locating a sleeper inside a related housing provided in the prefabricated reinforced concrete platform.
Figure 7:
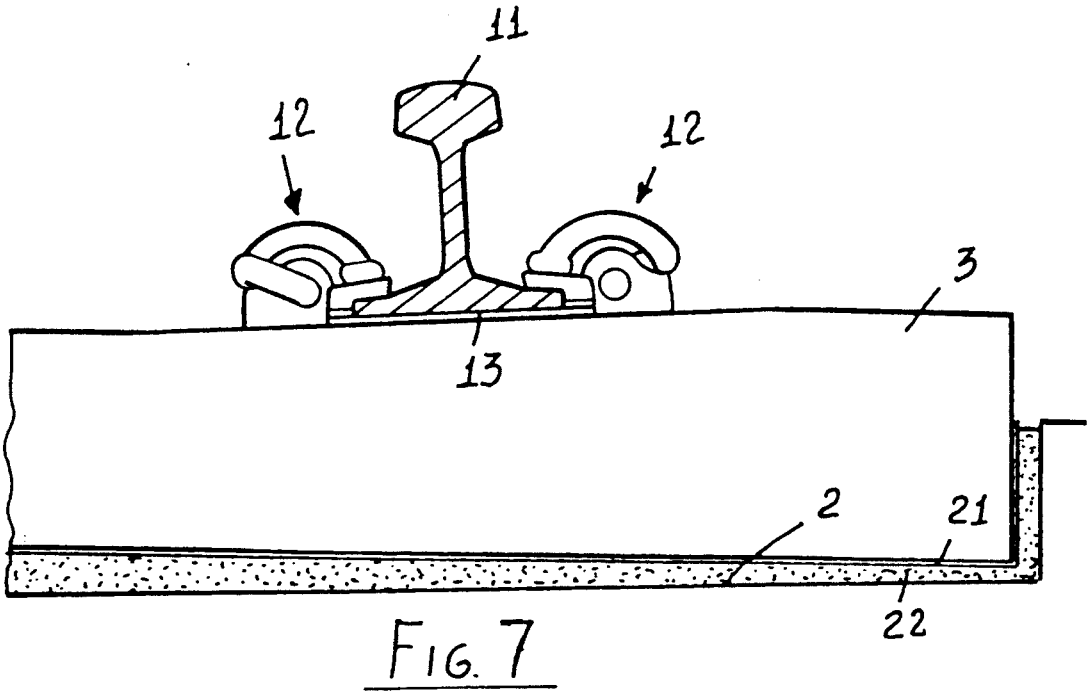

With reference to the number references of the above mentioned figures, the railroad superstructure supporting framework according to the present invention comprises a prefabricated reinforced concrete platform, generally indicated at the reference number 1, comprising a substantially parallelepipedal block having, on the top face thereof, a plurality of evenly spaced and parallel recesses 2.

These recesses 2 are so designed as to house, with a set cross and longitudinal clearance, a plurality of sleepers 3, which are of the pre-compressed reinforced concrete prefabricated type.

The depth of the above mentioned recesses is less than the height of the sleepers 3, so as to allow the sleepers to upwardly project from the platform 1.

At the middle longitudinal axis of the platform 1 there is arranged a channel member 4, which transversely crosses the recesses 2 and extends for the overall length of the platform.

On the block of the platform 1 there are moreover provided draining channels 5 which extend from the mentioned channel element 4, in a transversal direction, and exit the sidewalls of the platform.

Advantageously, the platform 1 is provided with adjustable height foot elements, of any known types, which are housed in suitable holes 6 and traverse the platform from the top face to the bottom face thereof.

As shown, said platform 1 is also provided with a plurality of holes 7 extending from the top face to the bottom face thereof, in order to allow bedding material to be conveyed between the platform 1 and the foundation on which the platform is arranged.

The walls and bottom of the recesses 2 are coated by an elastomeric material layer.

Moreover, to the bottom face of the platform 1 there is applied a resilient material layer, for example made of resilient mattress elements, having preferably a thickness from 10 to 25 mm, depending on requirements, and which are glued at a set position.

Near the longitudinal end portions of the channel element 4, there are formed throughgoing holes 8 which are used to fix the platform 1 to the foundation 9, made of reinforced concrete, and to connect to one another the several platforms, by means of a prefabricated type of joint element 10.

Figure 8:
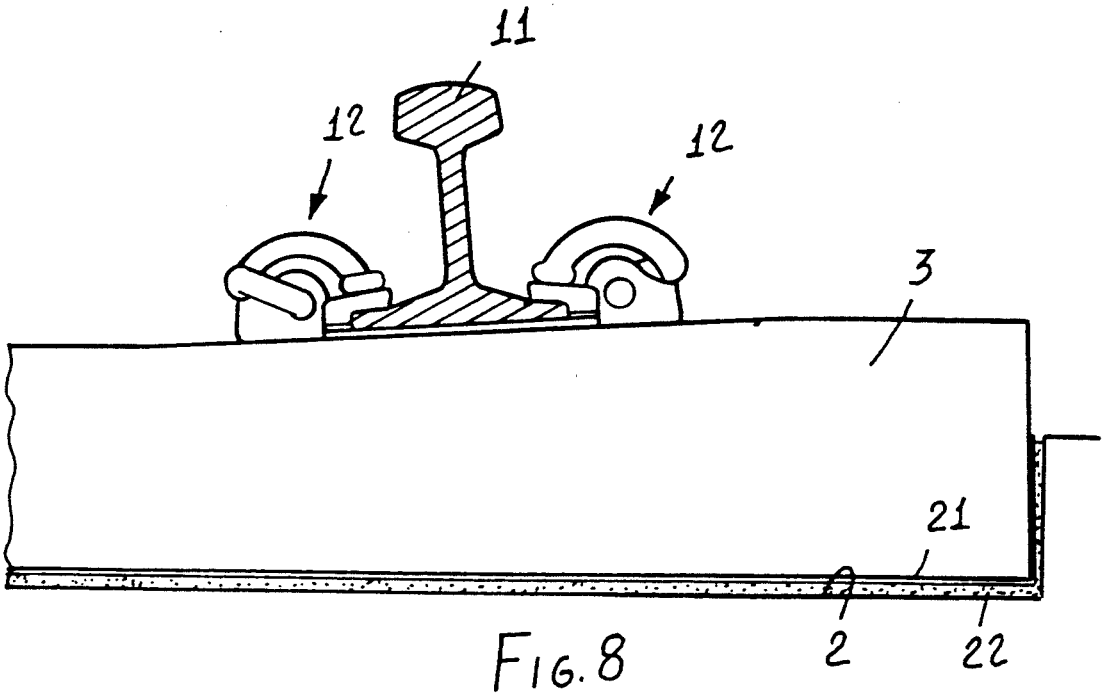
Figure 9:
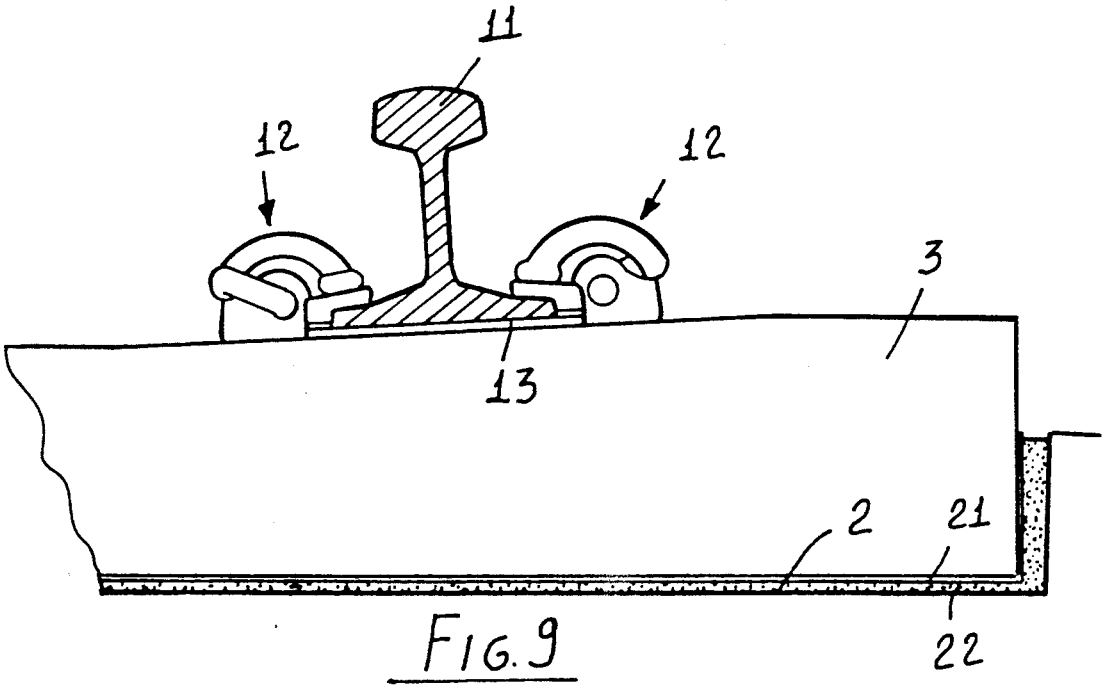

The sleepers 3 are engaged in their recesses 2 through the interposition of a bedding material, comprising a polyurethane resilient cap 21, contacting the sleeper and supported by injecting fluid concrete material 22, of high strength, provided for filling, by a falling or pumping effect, the remaining cavity between the sleeper 3 and its related recess 2 the walls of which, as stated, are coated by an elastomeric material layer (see FIGS. 8 and 9).

Accordingly there are provided two tandem arranged bedding steps: the first, consisting of the polyurethane resilient cap 21, having the required duration and reliability features, and the second consisting of the concrete fluid material 22, for example a concrete material commercially known with the mark of RECOMAT, having a high strength, and adapted to quickly fill the hollows of the recesses 2, and also adapted to resist against any outer stresses.

The sleeper 3, made of pre-compressed reinforced concrete, and having a mass much less than that of the platform, allows to absorb without any damages the dynamic stresses, pulses and shocks due to the train car components coupled to the sprung and un-sprung masses of the cars and increased by possible surface unevennesses of the train wheels and rails, by the geometric unevennesses of the latter as well as by the impacts and shocks due to the movements of the cars about their vertical axis, because of the reaction forces transmitted by the rails.

On the sleepers 3 there are arranged the rails 11 which are affixed by means of resilient clamping means 12, of any known type, for example of the type commercially known with the mark PANDROL, through the interposition of a resilient under rail sole 13.

The laying and fine adjusting procedure for the geometry of the rail, in the railroad superstructure supporting framework according to the invention is as follows.

The laying of the railroad superstructure supporting framework according to the present invention, provides the building of a reinforced concrete foundation, which is directly poured, by means, for example, of a precision vibrating-finishing machine.

As the curing of the concrete permits this, one can lay stopper elements which are affixed to the underlaying foundation, for example by means of affixing pins, recoring, by means of an epoxide mortar.

During this step, it is not necessary to perform any fine adjustements of the platforms since the final adjustement will be performed on the rail spans and related sleepers; on the other hand, some laying tolerances must be respected.

Since no fine adjustement is necessary with respect to the platforms 1, the latter can be quickly installed, without the need of performing frequent adjustments of the foot elements, since the tolerances of the foundation, which is made with a good precision, are of the same magnitude order as those required for the laying of the platforms.

If required, an adjustement of the positions of the platforms 1 can be anyhow performed, by operating on the adjustable foot elements and then the bedding concrete material 23 will be pumped between the platforms 1 and the foundation 9.

This bedding concrete is not affected by the environment moisture and it does not require steam or other means for a quick curing thereof, and is not subjected to any substantiall contraction or cracks, has an optimum resistance against compression and flexure so as to prevent any cracks from being formed susceptible to receive degrading rain water.

After having installed the platforms, the sleepers can be arranged in their recesses and the rail span can be then installed.

Then an adjustement and aligning step will be performed, by suitably displacing the sleepers 3 in their recesses 2, and, after this step, the bedding concrete 22 will be poured into said recesses 2.

The possibility of performing a fine locating of the sleepers 3 in their recesses 2 formed in the platform 1 allows to meet the set tolerances, even if they are very small.

The day after the pouring, or pumping, of the bedding concrete into the recesses 2 for the sleepers, the rail can be used, if necessary, for a normal railroad operation.

From the above disclosure and the figures of the accompanying drawings, it should be apparent that the railroad superstructure supporting framework according to the invention provides a geometric configuration which is very accurate, and has a great reliability and duration, as well as a very reduced environment impact, with respect to the prior art supporting framework systems for the intended use.

While the invention has been disclosed and illustrated with reference to a preferred embodiment thereof, it should be apparent that the disclosed embodiment is susceptible to several modifications and variation all of which will come within the spirit and scope of the appended claims.

We claim:

1. A railroad superstructure supporting reinforced concrete framework, comprising a reinforced concrete block having, on a top face thereof, a plurality of evenly spaced parallel recesses provided for receiving each, with a set clearance, a sleeper for supporting rail elements, said sleeper having a height greater than a depth of said recesses, on a middle region of said top face of said block there being provided a channel element, which transversely crosses said recesses, in said block there being moreover provided a plurality of draining channels extending transversely from said channel element and leading to an outside environment.

2. A framework according to claim 1, wherein said recesses are provided with sidewalls and bottoms which are both coated by an elastomeric material layer.

* * * * *